US006805485B2

(12) United States Patent
Hogan et al.

(10) Patent No.: US 6,805,485 B2
(45) Date of Patent: Oct. 19, 2004

(54) GUSSETED RECLOSABLE PACKAGE WITH SLIDER-OPERATED ZIPPER

(75) Inventors: Robert E. Hogan, Burr Ridge, IL (US); Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 67 days.

(21) Appl. No.: 10/263,236

(22) Filed: Oct. 2, 2002

(65) Prior Publication Data

US 2004/0066983 A1 Apr. 8, 2004

(51) Int. Cl.[7] ..... B65D 33/16

(52) U.S. Cl. ..... 383/64; 383/120; 383/210; 383/61.2

(58) Field of Search ..... 383/120, 63, 64, 383/210, 211, 203, 61.2

(56) References Cited

U.S. PATENT DOCUMENTS

| | | | | | |
|---|---|---|---|---|---|
| 2,358,653 | A | * | 9/1944 | Mock | 383/64 |
| 2,929,123 | A | * | 3/1960 | Schneideman | 24/399 |
| 4,241,865 | A | * | 12/1980 | Ferrell | 383/204 |
| 4,620,320 | A | * | 10/1986 | Sullivan | 383/203 |
| 4,736,450 | A | * | 4/1988 | Van Erden et al. | 383/65 |
| 4,971,454 | A | * | 11/1990 | Branson et al. | 383/204 |
| 5,035,517 | A | * | 7/1991 | Edelman | 383/204 |
| 5,037,138 | A | * | 8/1991 | McClintock et al. | 383/34 |
| 5,364,189 | A | * | 11/1994 | Kuge et al. | 383/61.2 |
| 5,692,837 | A | * | 12/1997 | Beer | 383/210.1 |
| 5,782,562 | A | * | 7/1998 | Anspacher | 383/15 |
| 5,788,378 | A | * | 8/1998 | Thomas | 383/63 |
| 6,132,089 | A | * | 10/2000 | Galomb et al. | 383/63 |
| 6,164,826 | A | | 12/2000 | Petkovsek | |
| 6,186,663 | B1 | | 2/2001 | Ausnit | |
| 6,254,273 | B1 | * | 7/2001 | Galomb et al. | 383/63 |
| 6,296,388 | B1 | * | 10/2001 | Galomb et al. | 383/63 |
| 6,325,543 | B1 | | 12/2001 | Ausnit | |
| 6,332,712 | B1 | * | 12/2001 | Headley | 383/64 |
| 6,393,804 | B1 | | 5/2002 | Ausnit | |
| 6,461,043 | B1 | * | 10/2002 | Healy et al. | 383/204 |
| 6,464,394 | B1 | * | 10/2002 | Galomb | 383/10 |
| 6,572,267 | B1 | * | 6/2003 | Forman | 383/61.2 |

FOREIGN PATENT DOCUMENTS

| | | |
|---|---|---|
| DE | 3144702 A1 | 5/1983 |
| DE | 20012652 U1 | 11/2000 |

* cited by examiner

*Primary Examiner*—Jes F. Pascua
(74) *Attorney, Agent, or Firm*—Ostrager Chong Flaherty & Broitman P.C.

(57) ABSTRACT

A gusseted bag has front and rear walls interconnected by a pair of side gussets and a slider-operated zipper. The zipper comprises a pair of profiled closure members that are engaged and disengaged by operation of the slider. No part of the side gussets is captured between the profiled closure members when the latter are interlocked. In one embodiment, the zipper extends beyond the front and rear walls on both sides thereof. In a fully closed position of the slider, at least part of the slider extending beyond one side of the front and rear walls. A sufficient portion of the slider extends beyond one side of the front and rear walls so that the first and second profiled closure members are interlocked across the entire width of the front and rear walls.

10 Claims, 3 Drawing Sheets

GUSSETED RECLOSABLE PACKAGE WITH SLIDER-OPERATED ZIPPER

BACKGROUND OF THE INVENTION

This invention generally relates to slider-operated flexible zippers for use in reclosable pouches, bags or other packages. In particular, the invention relates to gusseted reclosable packages having slider-operated zippers.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure members, etc.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

Other types of slider-operated zipper assemblies avoid the use of a separating finger. For example, U.S. Pat. No. 5,809,621 discloses a slider-operated zipper assembly wherein one zipper profile has a pair of handles that cooperate with the slider. As the slider is moved in an opening direction, the handles are squeezed together to disengage the profiles. In U.S. Pat. No. 5,442,838, a slider-operated zipper assembly is disclosed wherein the zipper profiles are engaged and disengaged in the course of a "rolling action". This "rolling action" is described as being achieved through cooperation between flanges on the profiles and shoulders which project inwardly from the arms of the slider. U.S. Pat. No. 6,047,450 discloses a zipper comprising a pair of mutually interlockable profiled structures. Portions of the two profiled structures form a fulcrum about which the profiled structures may be pivoted out of engagement when lower edges of the bases are forced towards each other Gusseted bags having plastic zippers are well known in the reclosable packaging art. One advantage of such gusseted bags is that they may be opened more fully to facilitate filling the bag and later removing its contents. In some designs a gusseted side of the bag can be used to form a pouring spout by pulling the gusset outward and then inverting the bag, in which event the pourable contents of the package can be made to pour down the v-shaped channel formed by the gusset panels.

In early concepts for such bags, the profiles of the plastic zipper had to be sufficiently large to capture a double thickness of the bag film in order to accommodate the gussets when the package was closed. Later designs for gusseted bags have side gussets that include portions aligned with the interlocking zipper profiles that are relatively thin as compared with the remainder of the bag walls.

U.S. Pat. No. 6,325,543 discloses a gusseted bag in which zipper profiles on a carrier strip are attached inside the bag. Profile-free sections of the carrier strip form part of the gusseted sides in the region of the bag mouth. The gussets may be open at both ends of the bag to provide a spout at either end or may be sealed together at one end to provide a spout at the opposite end. The front and rear walls of the bag and the gussets are joined together by interlocking the profiles as well as by capturing the profile-free areas of the gussets between the interlocking profiles. U.S. Pat. No. 6,325,543 does not disclose operating the zipper by means of a slider.

U.S. Pat. No. 6,186,663 discloses an embodiment of a gusseted bag in which the zipper is operated by a slider. The slider is configured so that the gussets, when folded, do not interfere with the operation of the slider. Therefore the disclosed embodiment employs a slider that does not have a separating finger. When the zipper is closed by the slider, the upper sections of the gussets are folded and captured between the interlocked zipper profiles. End stops are provided on the outside of the zipper parts to prevent the slider from sliding off the ends of the zipper. At the end of the package where the slider is parked when the zipper is fully open, the gusset will always be folded. Consequently, the latter end of the package mouth can never be opened widely because the gusseted side of the package in the area of the zipper cannot be expanded. However, this provides "little or no interference with expansion of the package gussets, especially towards the bottom of the package".

There is a need for alternative designs of gusseted bags having slider-operated zippers in which portions of the folded gussets are not captured between the zipper profiles, thereby allowing smooth uniform sliding of the slider along its entire run.

BRIEF DESCRIPTION OF THE INVENTION

The invention is directed to structures for side-gusseted bags or pouches having slider-operated zippers.

One aspect of the invention is a bag comprising: first and second walls, a first side gusset on one side of the bag interconnecting the first and second walls, and a second side gusset on an opposite side of the bag interconnecting the first and second walls; a flexible zipper comprising a first zipper part at least a major section of which is joined to the first wall and a second zipper part joined to the second wall, the first zipper part comprising a first profiled closure member and the second zipper part comprising a second profiled closure member that is engageable with the first profiled closure member to close the zipper; and a slider mounted to the zipper and configured to close portions of the zipper as the slider is moved in a first direction along the zipper and to open portions of the zipper as the slider is moved in a second direction along the zipper opposite to the first direction, wherein no portion of the first and second side gussets is captured between the first and second profiled closure members when the zipper is closed.

Another aspect of the invention is a bag comprising: first and second walls, a first side gusset on one side of the bag interconnecting the first and second walls, and a second side gusset on an opposite side of the bag interconnecting the first and second walls; a flexible zipper comprising a first zipper part at least a major section of which is joined to the first wall and a second zipper part joined to the second wall, the first zipper part comprising a first profiled closure member and the second zipper part comprising a second profiled closure member that is engageable with the first profiled closure member to close the zipper; and a slider mounted to the zipper and configured to close portions of the zipper as the slider is moved in a first direction along the zipper and to open portions of the zipper as the slider is moved in a second direction along the zipper opposite to the first direction, wherein a first end of the first zipper part is joined to a first end of the second zipper part, the first zipper part has a length greater than the width of an confronting section of the first wall and extends beyond the edges of the first wall on both sides thereof, and the second zipper part has a length greater than the width of an confronting section of the second wall and extends beyond the edges of the second wall on both sides thereof.

A further aspect of the invention is a gusseted bag comprising front and rear walls interconnected by a pair of side gussets and a slider-operated zipper, the zipper comprising first and second zipper parts that in turn comprise first and second profiled closure members respectively, wherein no part of the side gussets is captured between the first and second profiled closure members when the latter are interlocked.

Another aspect of the invention is a gusseted bag comprising front and rear walls interconnected by first and second side gussets and a zipper having a length greater than the width of the front wall. The zipper comprises first and second zipper parts joined at respective first ends near to the first side gusset and engageable but not joined at respective second ends near to the second side gusset. Portions of the first and second zipper parts other than the joined first ends are engageable to close the zipper and disengageable to open the zipper. The second side gusset is configurable to form a pouring spout when the zipper is open.

Yet another aspect of the invention is a device comprising first and second elongated zipper parts of equal length joined at both ends, the first and second zipper parts being engageable and disengageable along a major section disposed between the joined ends, one of the joined ends being joined only by peel seal material and the other of the joined ends being permanently sealed.

Other aspects of the invention are disclosed and claimed below.

BRIEF DESCRIPTION OF THE DRAWINGS

Reference will now be made to the drawings, in which similar elements in different drawings bear the same reference numerals.

DETAILED DESCRIPTION OF THE INVENTION

Figure 1:
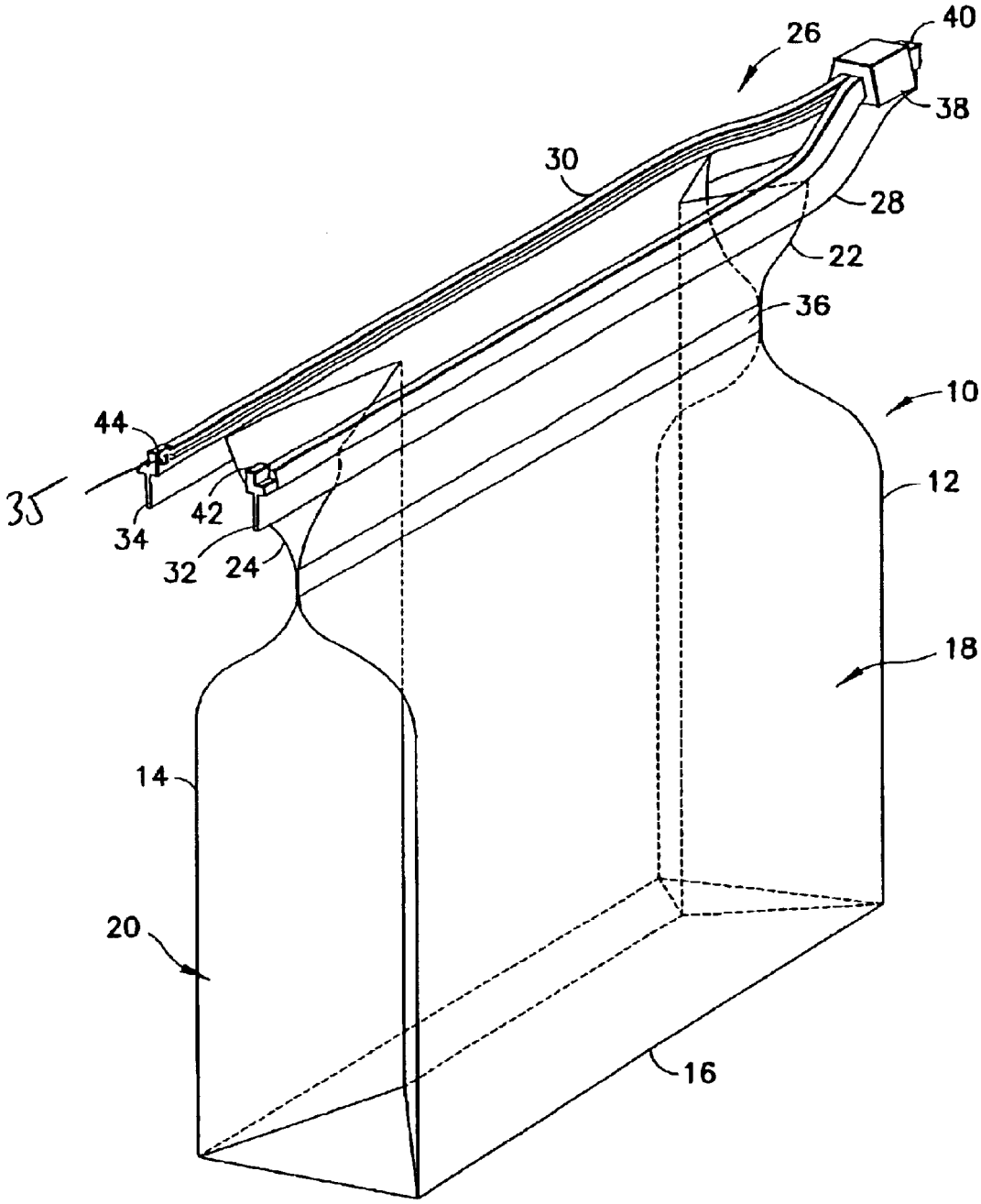
FIG. 1 is a drawing showing an isometric view of a reclosable gusseted bag having a slider-operated zipper in accordance with one embodiment of the invention.

A gusseted reclosable bag 10 in accordance with one embodiment of the invention is shown in FIG. 1. The bag 10 may be made from any suitable sheet material or plastic film. The gusseted bag 10 comprises first and second walls 12 and 14 extending upwardly from a bottom 16. The walls 12 and 14 are connected at opposite sides of the package by a pair of expanding side gussets 18 and 20. The first and second walls 12 and 14 each further comprise opposing free end portions 22 and 24 also interconnected by the expanding side gussets 18 and 20. The walls of the bag may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive.

At its top end, the bag 10 has an openable mouth, on the outside of which is an extruded plastic zipper 26. The zipper 26 comprises a pair of interlockable fastener strips or zipper halves 28 and 30. The profiles of the zipper halves 28 and 30 may take any form. For example, the zipper may comprise interlocking rib and groove elements or alternating hook-shaped closure members. The preferred zipper material is polyethylene.

In accordance with the embodiment depicted in FIG. 1, the zipper parts 28 and 30 are respectively positioned outside the opposing free end portions 22 and 24 and are joined to the top edges of those portions, e.g., by conduction heat sealing, application of adhesive or activation of bonding strips. For the purpose of joinder, each zipper half may be provided with a respective extension flange, to which the top edge of a respective wall is joined. In the embodiment depicted in FIG. 1, an extension flange 32 of the first zipper part 28 is sealed to free end portion 22 of wall 12 by conventional heat sealing, while an extension flange 34 of the second zipper part 30 is sealed to free end portion 24 of wall 14. No portion of either gusset 18 or 20 is captured between the profiled closure members when the zipper 26 is closed. Thus the zipper parts respond uniformly across the entire width of the package as the profiled closure members are engaged and disengaged during closing and opening. Also the profiled closure members need not be designed with sufficient tolerances to permit thinned areas of the bag film to be captured therebetween.

The zipper parts 28 and 30 are of equal length and are fused at one end by a high-strength heat seal, while the other ends of the zipper parts, once the bag has been opened, are not joined to each other. Optionally, prior to first opening of the bag, the other ends of the zipper parts may be joined by a peel seal that resists inadvertent opening of the unfused ends of the zipper parts and also provides tamper evidence. In FIG. 1, the area designated 35 represents a remnant of peel seal material on the end of zipper part 30 after the peel seal has been broken. A similar remnant of peel seal material would be found on the confronting area on the end of zipper part 28, but such remnant cannot be seen in the view of FIG. 1. The length of the zipper 26 is greater than the width of either wall 12 or 14, the opposing ends of the zipper both extending beyond the respective side edges of walls 12 and 14.

The zipper parts 28 and 30 are alternately engaged or disengaged by means of a conventional slider 38. The slider 38 is generally shaped so that it straddles the zipper parts. The ends of the slider are open to allow the zipper parts to pass through. The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

A bag incorporating a zipper and a slider preferably includes means, such as end stops, for preventing the slider from sliding off the end of the zipper when the slider reaches the closed or fully opened position. Such end stops typically perform dual functions, serving as stops to prevent the slider from going off the end of the zipper and also holding the two zipper profiles together to prevent the bag from opening in response to stresses applied to the profiles through normal use of the bag. The end stops may, for example, comprise stomped areas on the zipper profiles themselves, riveted end clamps, plastic end clips fused to the zipper, molded end posts, UV-cured plastic, or any other suitable structure. At a joined end of the zipper, the stomped end stops can be sections of the profiles that are fused together and deformed proximate to a slider park position such that the end stop is formed by upwelled plastic material. Stomping can be carried out by, for example, applying heat and/or pressure or using ultrasonic methods.

In accordance with the embodiment depicted in FIG. 1, the joined ends of the zipper parts have an end stop 40; the unjoined end of zipper part 28 has an end stop 42; and the unjoined end of zipper part 30 has an end stop 44. The end stop 40 stops the slider 38 at the zipper fully open position (shown in FIG. 1), while end stops 42 and 44 combine to stop the slider at the zipper fully closed position (not shown in FIG. 1). The preferred method for forming end stops 40, 42 and 44 is by ultrasonic sculpting. Preferably only the upper portion of the zipper parts is sculpted to cause a mass of molten plastic material to flow upward, while leaving the lower or rail portions of the zipper parts intact in order to maximize slider pull-off resistance at the end stops.

Thus the slider 38 can slide along the zipper 26 in either direction, with the limits to slider movement being established by the end stops located at opposing ends of the zipper. When the slider is moved leftward from the position shown in FIG. 1 to a position abutting the end stops 42 and 44, the zipper will be closed from a point inside the slider to the end stop 40. Conversely, when the slider is moved in the opposite direction, i.e., back to the position shown in FIG. 1, the zipper parts 28 and 30 are completely separated to the left of the slider. Since the ends of the zipper parts 28 and 30 where end stops 42 and 44 are located are not joined, these ends can be separated and the intervening side gusset expanded to allow the consumer additional access to the interior of the gusseted bag 10.

Optionally, the bag further comprises a peel seal 36 that joins the opposing free end portions 22, 24 and the side gussets 18, 20 along a horizontal band-shaped zone or section. One purpose of peel seal 36 is to hermetically seal the contents of the bag at an elevation below the zipper line. Another purpose of peel seal 36 is to provide evidence of tampering with the contents of the package. In this case, to open the bag 10, the user simply slides the zipper open, grasps the free end portions 28 and 30, and pulls them apart until the peel seal 36 is ruptured.

Figure 2:
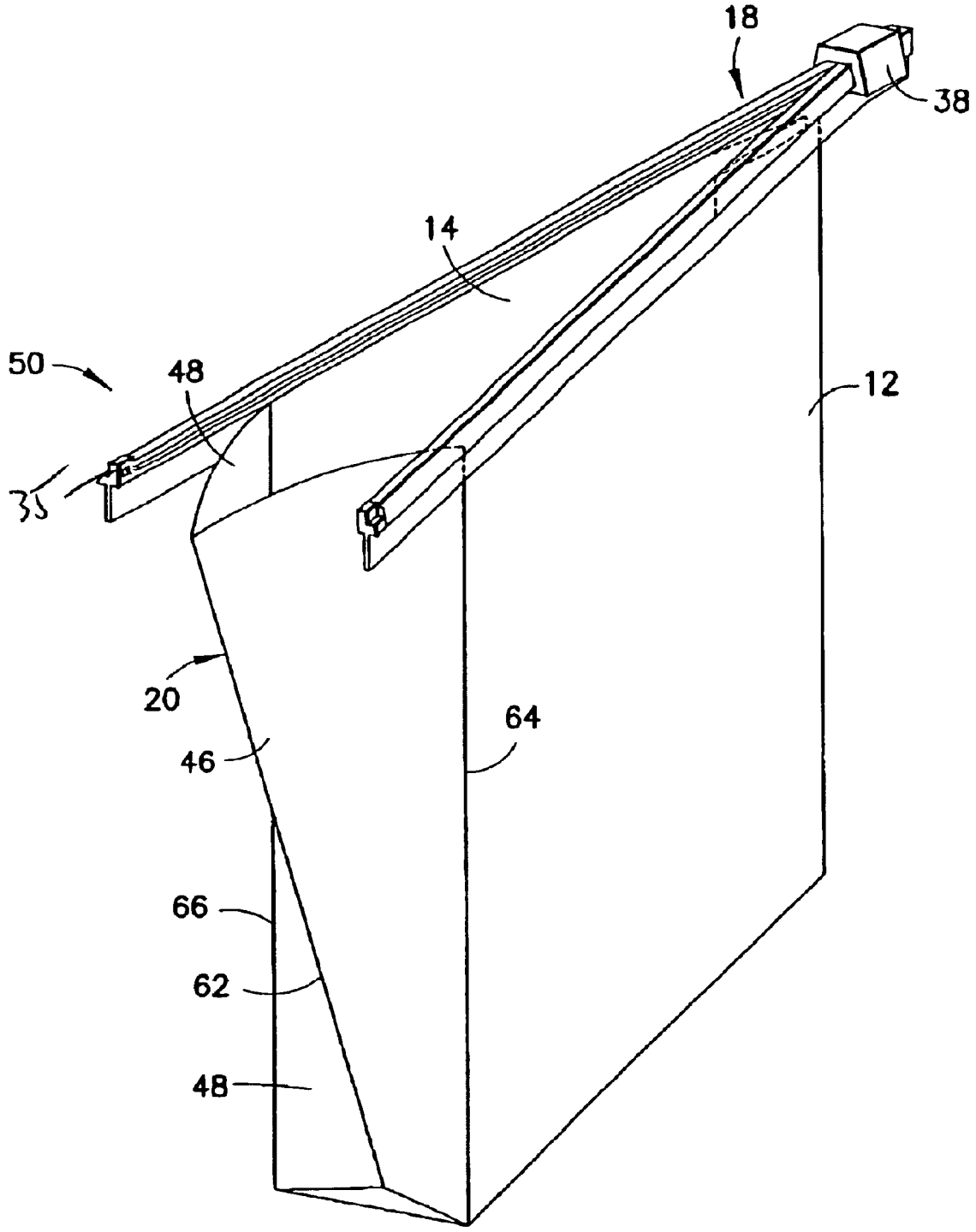
FIG. 2 is a drawing showing an isometric view of the gusseted bag of FIG. 1 wherein a portion of one gusset has been expanded to form a pouring spout.

After the zipper 26 has been fully opened and the peel seal 36 has been ruptured, the inwardly folded gusset 20 adjacent the separated ends of the zipper parts can be inverted, as shown in FIG. 2, to form a spout for pouring out the contents of the bag. In this embodiment, gusset 20 comprises a gusset panel 46 connected to a gusset panel 48 along a central fold line 62. On the side opposite the central fold line 62, gusset panel 46 is connected to the front wall 12 by a fold line 64. Similarly, the gusset panel 48 is connected to the rear wall 14 by a fold line 66. Alternatively, the gusset 20 can be a separate folded piece of bag film that is side sealed to the edges of the front and rear walls 12 and 14. This construction is not shown in the drawings.

Figure 3:
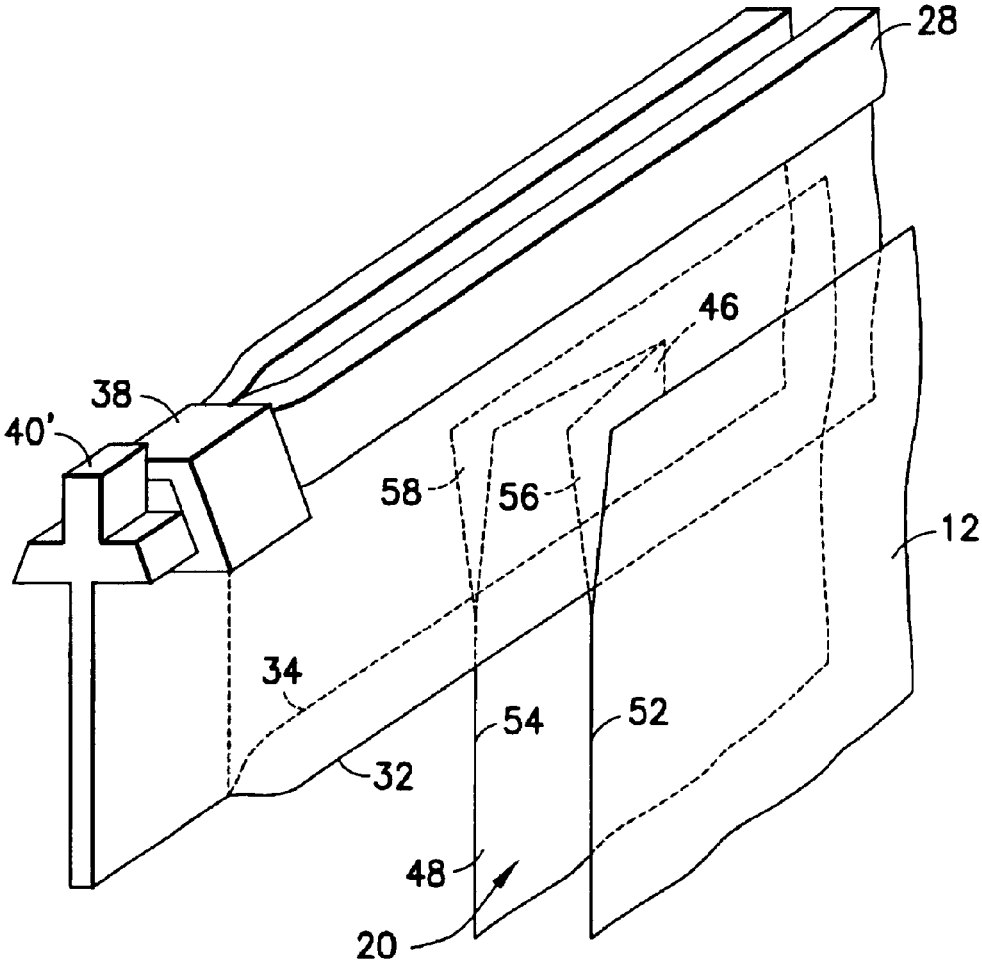
FIG. 3 is a drawing showing an isometric view of a precursor of a gusseted bag having a slider-operated zipper in accordance with another embodiment of the invention. In the final product, the slits along the junctions where the gusset meets the bag walls are closed by a side seal (not shown).
Figure 4:
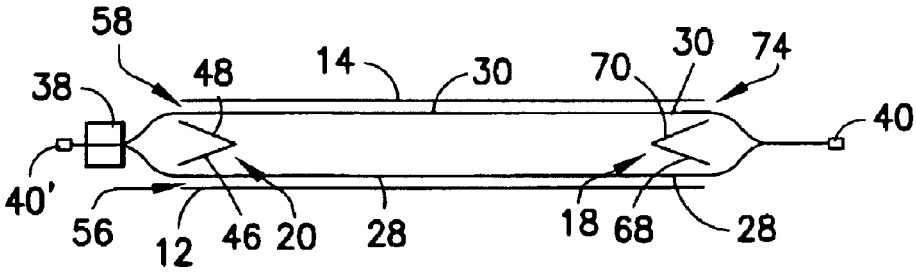
FIG. 4 is a drawing representing the positional relationships of the zipper and the gussets when the embodiment of FIG. 3 is viewed from the top.

In accordance with another embodiment of the invention, both ends of the zipper are stomped to form a respective end stop and to join the two zipper parts together. Such a bag construction is schematically represented in FIG. 4 and one side of such a bag is depicted in FIG. 3. The zipper parts 28 and 30 are fused together at both ends, respective end stops 40 and 40' being formed in the stomping process. As was the case for the previously described embodiment, both ends of the zipper extend beyond the side edges of the front and rear walls 12 and 14.

In the embodiment shown in FIGS. 3 and 4, however, instead of joining the extension flanges 32 and 34 of the zipper parts to the outside of the free end portion of the front and rear walls 12 and 14, the extension flanges are joined to the inside of those wall portions. To accomplish this, slits 56 and 58 are formed at the fold lines where gusset 20 connects to the front and rear walls respectively. More specifically, the gusset 20 comprises a front gusset panel 46 that is connected to front wall 12 along a fold line 52, a topmost section of which is cut to form slit 56. These slits 56 and 58 are indicated in FIG. 4 by the gaps that separate the left-hand edges of the walls 12 and 14 from the opposing edges of the panels 46 and 48 of gusset 20. Similarly, as seen in FIG. 4, slits 72 and 74 are indicated by the gaps that separate the right-hand edges of walls 12 and 14 from the opposing edges of the panels 68 and 70 of gusset 18. The extension flange of zipper part 28 is threaded through the slits 56 and 72 and then joined to the inside of the free end portion of wall 12. Likewise the extension flange of zipper part 30 is threaded through the slits 58 and 74 and then joined to the inside of the free end portion of wall 14.

Referring to FIG. 3, a narrow section of wall 12 adjacent to the slit 56 is side sealed to the exterior surface of the extension flange 32 and a narrow section of gusset panel 46 adjacent to the slit 56 (and opposite to the side seal on wall 12) is side sealed to the interior surface of the extension flange 32, thereby closing the slit 56. Likewise a narrow section of wall 14 adjacent to the slit 58 is side sealed to the exterior surface of the extension flange 34 and a narrow section of gusset panel 48 adjacent to the slit 58 (and opposite to the side seal on wall 14) is side sealed to the interior surface of the extension flange 34, thereby closing the slit 58. Slits 72 and 74 (see FIG. 4) are closed in a similar manner.

The result is a gusseted bag in which the zipper flanges are cross sealed and side sealed to the interior surfaces of the front and rear bag walls and are also side sealed to the interior surfaces of the respective adjacent gusset panels. Preferably the bag film is a plastic laminate having a layer of relatively low-melting-point thermoplastic sealant material and a layer of relatively high-melting point thermoplastic material. The layer of sealant material is on the side of the film that faces the interior of the bag. Thus the aforementioned side seals can be formed without seal-through of the gusset panels, since the opposing surfaces of the gusset panels of each gusset comprise layers of relatively high-melting-point thermoplastic material. A sealing temperature is selected at which the low-melting sealant material will melt but the high-melting outer layer will not. The sealant material may, for example, consist of: (1) a bulk polyolefin (preferably, a polypropylene-ethylene copolymer) that melts at a temperature below the melting temperature of the outermost layer (made, e.g., polyethylene); and (2) a thermoplastic elastomer. For example, the sealant layer may include SEBS and ethylene polypropylene. Any other suitable sealant material can be used.

A person skilled in the art of reclosable packaging will recognize that, whether the zipper is fused at only one end or at both ends, the zipper can be attached either to the exterior surfaces of the free end portions of the front and rear walls, as depicted in FIG. 1, or to the interior surfaces of the free end portions of the front and rear walls, as depicted in FIGS. 3 and 4.

In particular applications, it may be desirable to construct a gusseted bag wherein the zipper end stops are disposed outward of the edges on each side of the gusseted bag by a distance sufficient that the zipper opening portion of the slider, when parked in the fully open position (adjacent to end stop 40) or in the fully closed position (adjacent to end stops 40' or 42/44), does not overlap with the bag mouth. Thus, in both positions, full closure of the bag mouth by the zipper is assured.

In cases where both ends of the zipper are fused, it may also be desirable to design the bag so that the slider in the fully open position is displaced from the nearest side of the bag by a distance that allows the gusset on that side to be fully expanded. At the same time, the end stop at the opposite end of the zipper can be displaced from the opposite side of the bag by a distance that allows the opposite gusset to be fully expanded, thereby allowing for a wide mouth opening.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, or adhered, whether by application of heat and/or pressure, application of ultrasonic energy, application of a layer of adhesive material, peel seal material, or bonding agent, interposition of an adhesive or bonding strip, etc.

What is claimed is:

1. A bag comprising:

first and second walls, a first side gusset on one side of said bag interconnecting said first and second walls, and a second side gusset on an opposite side of said bag interconnecting said first and second walls;

a flexible zipper comprising a first zipper part at least a major section of which is joined to said first wall and a second zipper part joined to said second wall, said first zipper part comprising a first profiled closure member and said second zipper part comprising a second profiled closure member that is engageable with said first profiled closure member to close said zipper; and a slider mounted to said zipper and configured to close portions of said zipper as said slider is moved in a first direction along said zipper and to open portions of said zipper as said slider is moved in a second direction along said zipper opposite to said first direction, wherein a first end of said first zipper part is joined to a first end of said second zipper part, said first zipper part has a length greater than the width of an confronting section of said first wall and extends beyond the edges of said first wall on both sides thereof, and said second zipper part has a length greater than the width of an confronting section of said second wall and extends beyond the edges of said second wall on both sides thereof, and wherein said first zipper part is joined to an internal surface of said first wall and said second zipper part is joined to an internal surface of said second wall.

2. A bag comprising:

first and second walls, a first side gusset on one side of said bag interconnecting said first and second walls, and a second side gusset on an opposite side of said bag interconnecting said first and second walls;

a flexible zipper comprising a first zipper part at least a major section of which is joined to said first wall and a second zipper part joined to said second wall, said first zipper part comprising a first profiled closure member and said second zipper part comprising a second profiled closure member that is engageable with said first profiled closure member to close said zipper; and a slider mounted to said zipper and configured to close portions of said zipper as said slider is moved in a first direction along said zipper and to open portions of said zipper as said slider is moved in a second direction along said zipper opposite to said first direction, wherein a first end of said first zipper part is joined to a first end of said second zipper part, said first zipper part has a length greater than the width of an confronting section of said first wall and extends beyond the edges of said first wall on both sides thereof, and said second zipper part has a length greater than the width of an confronting section of said second wall and extends beyond the edges of said second wall on both sides thereof, and wherein respective first ends of said first and second zipper parts are joined to each other by a permanent seal, and respective second ends of said first and second zipper parts are joined to each other by a peel seal.

3. The bag as recited in claim 1, further comprising peel seal means for sealing the bag at an elevation below said zipper.

4. A bag comprising:

first and second walls, a first side gusset on one side of said bag interconnecting said first and second walls, and a second side gusset on an opposite side of said bag interconnecting said first and second walls;

a flexible zipper comprising a first zipper part at least a major section of which is joined to said first wall and a second zipper part joined to said second wall, said first zipper part comprising a first profiled closure member and said second zipper part comprising a second profiled closure member that is engageable with said first profiled closure member to close said zipper; and a slider mounted to said zipper and configured to close portions of said zipper as said slider is moved in a first direction along said zipper and to open portions of said zipper as said slider is moved in a second direction along said zipper opposite to said first direction, wherein a first end of said first zipper part is joined to a first end of said second zipper part, said first zipper part has a length greater than the width of an confronting section of said first wall and extends beyond the edges of said first wall on both sides thereof, and said second zipper part has a length greater than the width of an confronting section of said second wall and extends beyond the edges of said second wall on both sides thereof, and wherein said first zipper part further comprises a first zipper flange connected at one end to said first profiled closure member, and said second zipper part further comprises a second zipper flange connected at one end to said second profiled closure member, said bag further comprising a first slit severing adjoining portions of said first side gusset and said first wall, a second slit severing adjoining portions of said first side gusset and said second wall, a third slit severing adjoining portions of said second side gusset and said first wall, and a fourth slit severing adjoining portions of said second side gusset and said second wall, said first zipper flange penetrating said first and third slits and said second zipper flange penetrating said second and fourth slits, said adjoining portions of said first side gusset and said first wall being joined to said first zipper flange, said adjoining portions of said first side gusset and said second wall being joined to said second zipper flange, said adjoining portions of said second side gusset and said first wall being joined to said first zipper flange, and said adjoining portions of said second side gusset and said second wall being joined to said second zipper flange.

5. A gusseted bag comprising front and rear walls interconnected by a pair of side gussets and a zipper having a length greater than the width of said front wall, said zipper comprising first and second zipper parts that in turn comprise first and second profiled closure members respectively, wherein no part of said side gussets is captured between said first and second profiled closure members when the latter are interlocked, wherein said first zipper part further comprises a first zipper flange connected at one end to said first profiled closure member, and said second zipper part further comprises a second zipper flange connected at one end to said second profiled closure member, said bag further comprising a first slit severing adjoining portions of said first side gusset and said first wall, a second slit severing adjoining portions of said first side gusset and said second wall, a third slit severing adjoining portions of said second side gusset and said first wall, a fourth slit severing adjoining portions of said second side gusset and said second wall, said first zipper flange penetrating said first and third slits and said second zipper flange penetrating said second and fourth slits, said adjoining portions of said first side gusset and said first wall being joined to said first zipper flange, said adjoining portions of said first side gusset and said second wall being Joined to said second zipper flange, said adjoining portions of said second side gusset and said first wall being joined to said first zipper flange, and said adjoining portions of said second side gusset and said second wall being joined to said second zipper flange.

6. The gusseted bag as recited in claim 5, further comprising peel seal means for sealing the bag at an elevation below said zipper.

7. The gusseted bag as recited in claim 5, further comprising a slider mounted to said zipper.

8. The bag as recited in claim 1, wherein no portion of said first and second side gussets is captured between said first and second profiled closure members when said zipper is closed.

9. The bag as recited in claim 2, wherein no portion of said first and second side gussets is captured between said first and second profiled closure members when said zipper is closed.

10. The bag as recited in claim 4, wherein no portion of said first and second side gussets is captured between said first and second profiled closure members when said zipper is closed.

* * * * *